US007147425B2

(12) United States Patent
Holt

(10) Patent No.: US 7,147,425 B2
(45) Date of Patent: Dec. 12, 2006

(54) CONVERTIBLE COMPACT LOADER AND EXCAVATOR

(76) Inventor: John Andrews Holt, 633 Heritage Way, Belvidere, IL (US) 61008

( * ) Notice: Subject to any disclaimer, the term of this patent is extended or adjusted under 35 U.S.C. 154(b) by 0 days.

(21) Appl. No.: 10/744,947

(22) Filed: Dec. 23, 2003

(65) Prior Publication Data

US 2005/0169738 A1 Aug. 4, 2005

(51) Int. Cl.
*E02F 3/28* (2006.01)

(52) U.S. Cl. ..... 414/694; 37/403; 37/411; 414/912

(58) Field of Classification Search ..... 414/694, 414/687, 680, 912; 37/403, 411
See application file for complete search history.

(56) References Cited

U.S. PATENT DOCUMENTS

| | | | | |
|---|---|---|---|---|
| 2,427,968 | A | | 9/1947 | Hoover |
| 2,455,474 | A | | 12/1948 | Drott et al. |
| 2,529,338 | A | | 11/1950 | Hoover |
| 2,715,472 | A | | 8/1955 | McEwen |
| 2,764,302 | A | | 9/1956 | Webb |
| 2,846,096 | A | | 8/1958 | Beyerstedt et al. |
| 3,057,496 | A | | 10/1962 | Garske |
| 3,465,904 | A | * | 9/1969 | Pensa ..... 414/694 |
| 3,656,642 | A | | 4/1972 | Kostas et al. |
| 4,393,607 | A | * | 7/1983 | Hirosawa ..... 414/687 |
| 4,408,949 | A | * | 10/1983 | Witty ..... 414/694 |
| D294,032 | S | | 2/1988 | Whiffin |
| 5,195,863 | A | | 3/1993 | De Pingon |
| 5,295,318 | A | | 3/1994 | Schaeff |
| D359,497 | S | | 6/1995 | Rayner |
| 5,484,250 | A | * | 1/1996 | Gilmore et al. ..... 414/723 |
| D431,574 | S | | 10/2000 | Porter |
| D438,218 | S | | 2/2001 | McIllwraith |
| 6,397,967 | B1 | | 6/2002 | McIllwraith |
| D463,454 | S | | 9/2002 | Miller et al. |
| D466,910 | S | | 12/2002 | Miller et al. |
| D469,448 | S | | 1/2003 | Bares et al. |
| D470,512 | S | | 2/2003 | Stanley et al. |
| D470,513 | S | | 2/2003 | Miller et al. |
| D472,904 | S | | 4/2003 | Bares et al. |
| D479,535 | S | | 9/2003 | Lange |
| 2003/0108414 | A1 | | 6/2003 | Walto et al. |

* cited by examiner

*Primary Examiner*—Donald W. Underwood

(57) ABSTRACT

A loader excavator is described that is operable in an excavation mode or in a loader mode. The loader excavator comprises a main boom and a dipper boom, wherein a loader bucket or an excavator bucket can be selectively utilized in accordance with user preference.

19 Claims, 5 Drawing Sheets

CONVERTIBLE COMPACT LOADER AND EXCAVATOR

BACKGROUND OF THE INVENTION

This invention relates to a compact utility loader that is convertible to an excavator and vice versa. More particularly, this invention relates to a tracked machine adapted for use in outdoor construction environments.

SUMMARY OF THE INVENTION

A multi-purpose convertible skid loader and excavator is disclosed. An operator can convert the machine from a skid loader to an excavator without leaving the cab, through manipulation of hydraulic controls.

A loader excavator is described that is operable in an excavation mode or in a loader mode. The loader excavator comprises a main boom and a dipper boom, wherein a loader bucket or an excavator bucket can be selectively utilized in accordance with user preference.

In the excavation mode, a main boom and a dipper boom are operable through hydraulic controls to raise and lower the excavator bucket. Excavation is generally characterized by the excavator bucket facing toward the operator, excavation of material accomplished by digging or drawing the material toward the operator and then lifted.

In a loader mode, the dipper boom is operable through hydraulic controls to raise and lower the loader bucket. Loading is generally characterized by the loader bucket facing away the operator, loading of material accomplished by digging or pushing the material away from the operator and then lifted.

The main boom operable in an excavation mode when said dipper boom is coupled with the excavator bucket; the dipper boom is operable in the excavation mode and a loader mode when said dipper boom is coupled with the loader bucket.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

Figure 1:
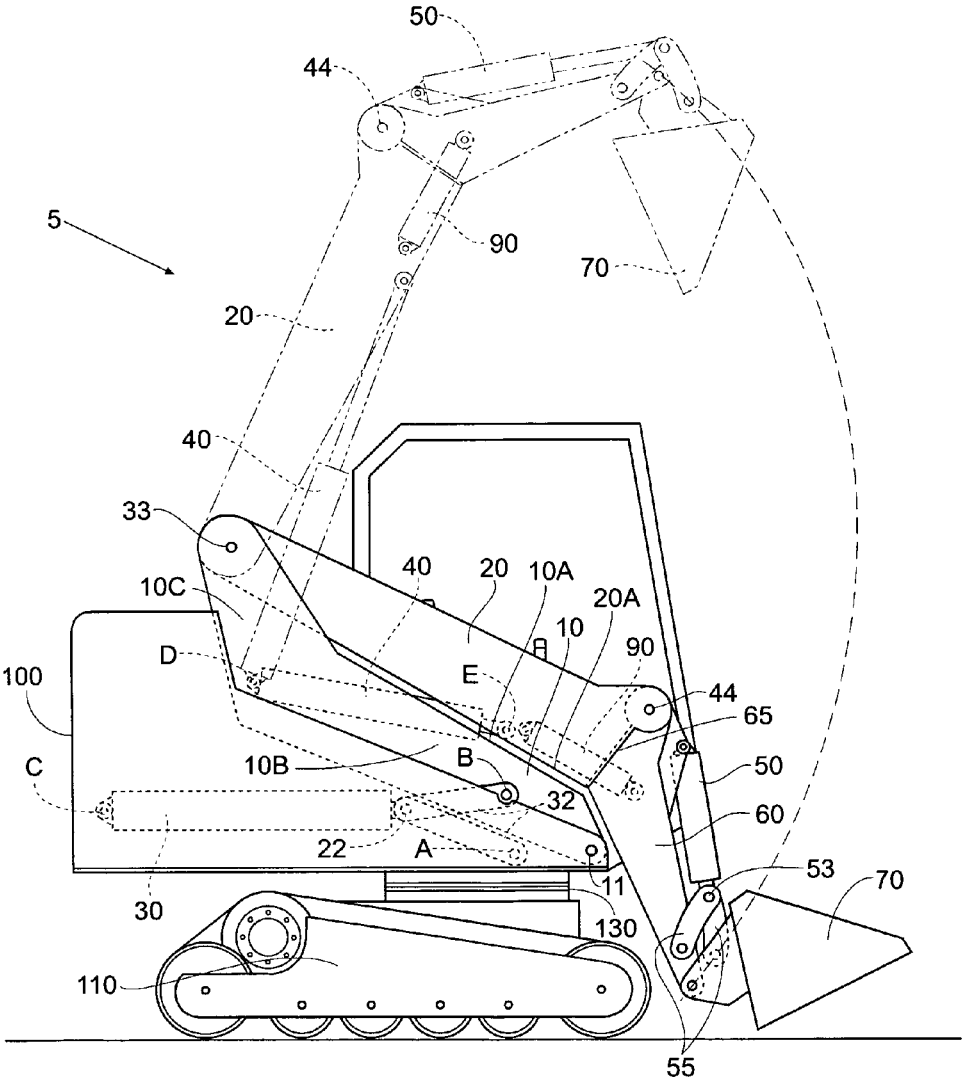
FIG. 1 is a side elevation view of a preferred embodiment of a convertible skid loader and excavator, shown in a loader mode, in phantom in an excavation mode.

FIG. 1 is a side elevation view of a preferred embodiment of a convertible skid loader and excavator 5, shown in a loader mode with a loader bucket 70, and in phantom in the loader mode with a dipper boom 20 fully extended.

The dipper boom 20 is operable through hydraulic controls (described later) to raise and lower the loader bucket 70. The loader bucket is also rotatable from a digging position (not shown) to a carrying position as shown, in which the front edge of the loader bucket 70 is slightly elevated with respect to the remainder of the bottom edge of the loader bucket 70.

Loading is generally characterized by the loader bucket 70 facing away the operator, loading of material accomplished by digging or pushing the material away from the operator and then lifted.

In loader mode, three hydraulic rams are utilized. First, dipper boom hydraulic ram 40, is operable to manipulate dipper boom 20 toward or away from main boom 10. Dipper boom hydraulic ram 40 rotates dipper boom 20 when the ram 40 is extended. At full extension of dipper boom hydraulic ram 40, dipper boom 20 will be in the position shown in phantom.

Second, bucket ram 50 operates to rotate the loader bucket 70 by extension of a bucket ram 50, which in turn causes ram links 55 to pivot about ram pin 53, resulting in rotation of the bucket 70.

Third, dipper extension hydraulic ram 90 is operable to manipulate dipper boom extension 60 toward or away from dipper boom 20.

The operator can move the loader/excavator forward or backward using the track sub-assembly 110, preferably containing an elevated drive sprocket as shown. Further, the operator can rotate the excavator/loader by engagement of a slew ring 130.

Main structure and engine compartment 100 houses the engine and other necessary peripherals (not shown) sufficient to drive the slew ring 130, track sub-assembly 110, and hydraulic controls operating the booms.

Figure 2:
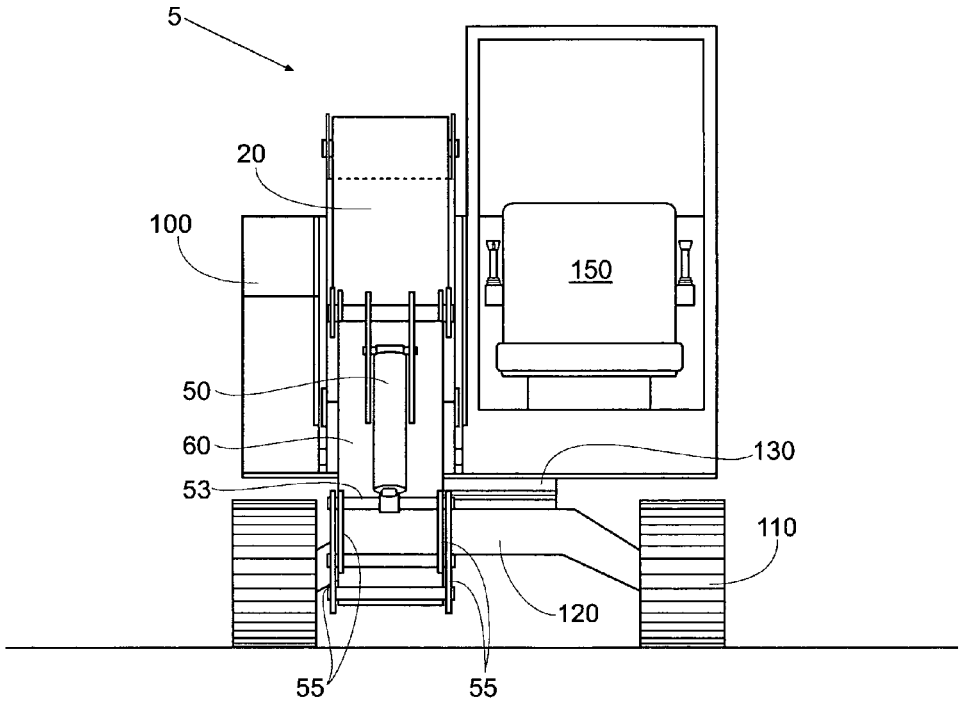
FIG. 2 is a front elevation view of a preferred embodiment of a convertible skid loader and excavator.

Referring now to FIG. 2, a front elevation view of the convertible skid loader and excavator is shown. In this view, it is apparent that extension of the bucket ram 50 causes pivoting of bucket ram links 55. Undercarriage 120 carrying the track sub-assembly 100 is shown. Operators will ordinarily be seated in seat 150.

Figure 3:
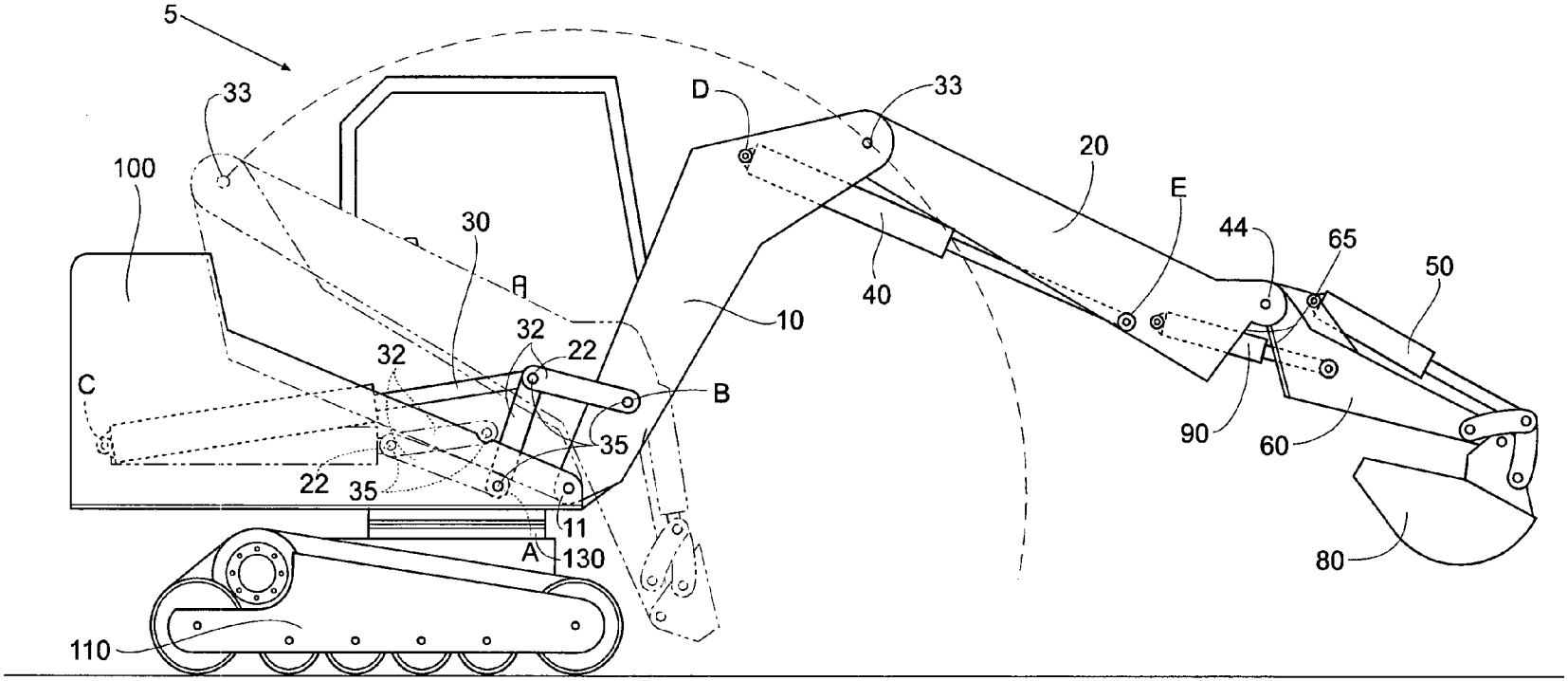
FIG. 3 is a side elevation view of a preferred embodiment of a convertible skid loader and excavator, shown in an excavator mode.

Referring now to FIG. 3, a side elevation view of a preferred embodiment of a convertible skid loader and excavator, shown in an excavator mode.

Excavation is generally characterized by the excavator bucket 80 facing toward the operator, excavation of material accomplished by digging or drawing the material toward the operator and then lifted.

In the excavation mode, the main boom 10 and the dipper boom 20 are operable through hydraulic controls to raise and lower the excavator bucket 80. In a preferred embodiment, the main boom 10 and the dipper boom 20 operate in the excavation mode, in contrast to the loader mode, when only the dipper boom 20 is preferably used.

In order to provide extension of the excavator bucket 80 away from the operator, as emphasized between the phantom and solid views of the dipper boom 20 and main boom 10, the main boom 10 is hydraulically extended by operation of the main boom hydraulic ram 30, which in turn causes main boom ram links 32 to rotate about main boom ram pins 35.

Dipper boom hydraulic ram 40 is extended to rotate the dipper boom 20 as previously described. Additionally, a dipper extension hydraulic ram 90 causes further extension of dipper boom extension 60, shown in FIG. 3 in an extended position. Manipulation of the bucket ram 50 causes rotation of the excavator bucket 80 in the same manner as previously described in relation to loader bucket 70.

Figures 4A, 4B, 4C:
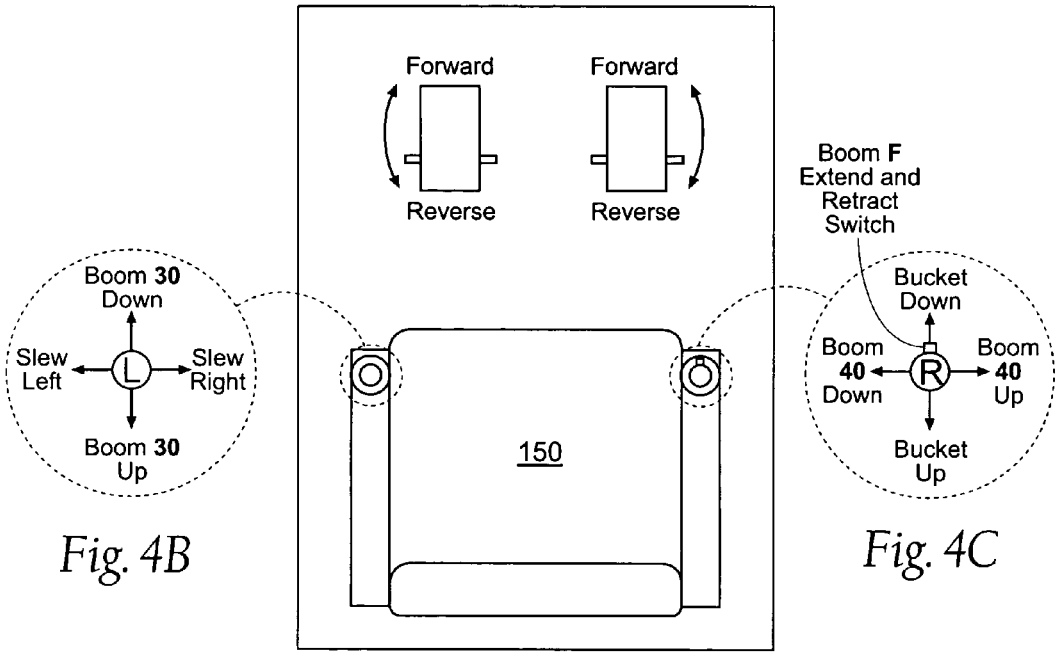
FIGS. 4*a–c* are top views of a preferred embodiment of operator control configuration.

Referring now to FIGS. 4*a–c*, top views of a preferred embodiment of operator control configuration are shown. While preferably seated in seat 150, an operator can operate a left track and a right track of track sub-assembly 110 by operating one of the forward-reverse actuators shown.

In order to move the main boom 10 by extension of main boom hydraulic ram 30, the user moves the Boom 30 Down or Up controls shown in FIG. 4*b*.

In order to move the dipper boom 20 by extension of dipper boom hydraulic ram 40, the user moves the Boom 40 Down or Up controls shown in FIG. 4*c*.

To rotate about slew ring 130, the operator moves the Slew Left or Right controls shown in FIG. 4*b*.

To rotate either the excavator bucket 80 or the loader bucket 70, the operator moves the Bucket down or up control on FIG. 4*c*.

Last, to extend or retract the dipper extension hydraulic ram 90, thereby raising or lowering the dipper boom extension 60, the operator engages the boom extend and retract switch shown on FIG. 4*c*.

Figure 5:
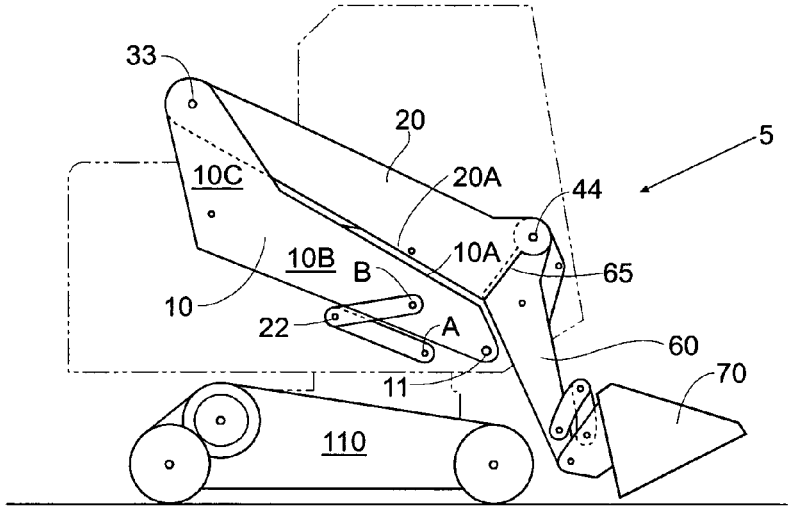
FIGS. 5 and 5*a* are detail views of bucket detachment.
Figure 5A:
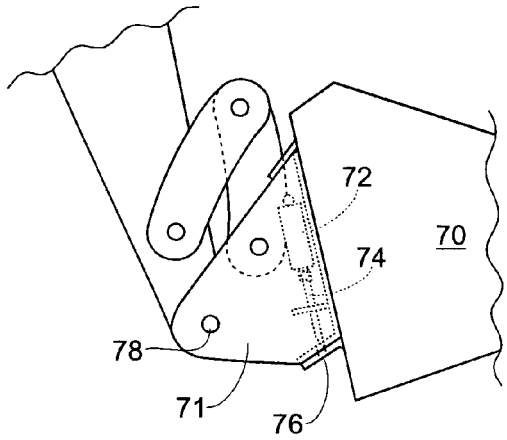
Figure 6:
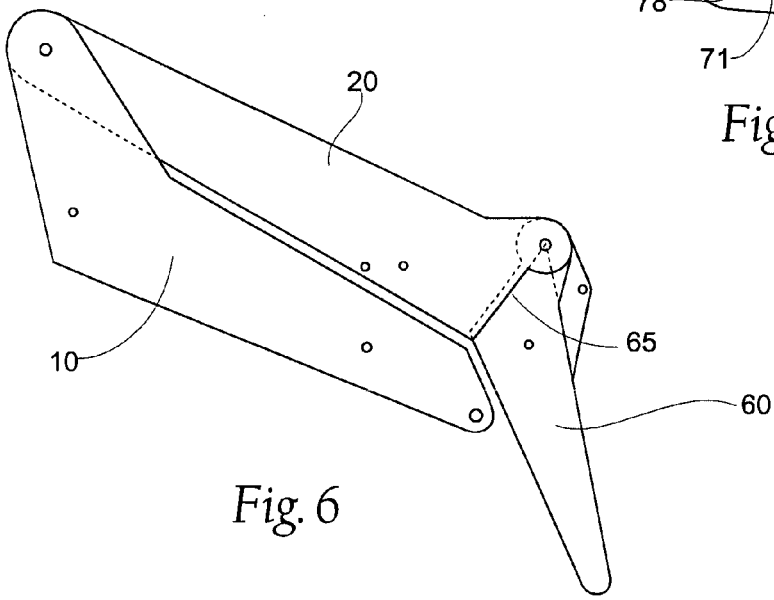
FIG. 6 is a detail views of hydraulic arms.

FIGS. 5 and 6 are detail views of hydraulic arms. Referring specifically to FIG. 5A, it can be seen that a pin 74 is coupled to a cleat ram 72 that can move up or down. A wedge on the pin 74 engages a hole in a tab 76 that is welded on the bucket 70 (or 80). This draws the bucket 70 (or 80) towards cleat 71 and locks it into place. The cleat 71 is coupled to the dipper boom extension 60 through bucket pin 78.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A loader-excavator for alternate use with a loader bucket in a loader mode and an excavator bucket in an excavation mode, the loader-excavator comprising:

a) a mobile frame powered for forward and rearward movement;

b) a main boom connected to the frame at a first pivot for movement between a retracted position and an extended position, the main boom extending rearwardly and inclined upwardly from the first pivot when in its retracted position;

c) first and second links connected together at a second pivot rearwardly of the first pivot and generally below the main boom when in its retracted position, the first and second links being further pivotally connected to the frame and the main boom respectively, the first and second links being pivotable from a first position with the main boom in its retracted position to a second position for movement of the main boom to its extended position;

d) a main ram connected between the second pivot and the frame rearwardly of the second pivot and at a height generally below the main boom when in its retracted position, the main ram being operable to actuate said links between said first and second positions for movement of the main boom between its retracted and extended positions respectively;

e) a dipper boom connected to the main boom at a third pivot for movement between a retracted position and an extended position, the third pivot being located rearwardly of and at a height above the first pivot with the main boom in its retracted position, the dipper boom extending forwardly and inclined downwardly from said third pivot proximately over the main boom when the main boom and dipper boom are in their retracted positions;

f) a dipper boom ram connected between the main boom and the dipper boom, the dipper boom ram being operable to pivot the dipper boom between its retracted and extended positions;

g) a dipper boom extension connected to the dipper boom at a fourth pivot for movement between a retracted position and an extended position, the fourth pivot being located forwardly of the third pivot when the main boom and dipper boom are in their retracted positions;

h) a dipper extension ram connected between the dipper boom and the dipper boom extension, the dipper extension ram being operable to pivot the dipper boom extension between its retracted and extended positions; and i) a lock mechanism for selectively coupling the loader bucket and the excavator bucket to the dipper boom extension.

2. The loader-excavator as defined in claim 1 further comprising an operator's seat carried by the frame, and in which the main boom and dipper boom extend alongside the operator's seat when in their retracted positions.

3. The loader-excavator as defined in claim 1 in which the fourth pivot is located at a height below the third pivot and closer to the height of the first pivot than the height of the third pivot with the main boom and dipper boom in their retracted positions.

4. The loader-excavator as defined in claim 1 in which the dipper boom extension extends generally downwardly from said fourth pivot to proximately past said first pivot forwardly thereof when the main boom and dipper boom and dipper boom extension are all in their retracted positions.

5. The loader-excavator as defined in claim 1 in which an overlapping joint is established between the dipper boom and the dipper boom extension with the dipper boom extension in its retracted position, said joint extending radially from said fourth pivot with respect to the pivotal axis thereof, said joint opening as the dipper boom extension moves from its retracted position.

6. The loader-excavator as defined in claim 1 in which the dipper boom extension ram is located inside the dipper boom and the dipper boom extension when both are in their retracted positions.

7. The loader-excavator as defined in claim 1 further comprising a switch controlling operation of the dipper boom extension ram between its retracted and extended positions.

8. The loader-excavator as defined in claim 1 in which, when the main boom and dipper boom are both in their retracted positions: the main boom includes an upper edge extending substantially along the forward length thereof, the dipper boom includes a lower edge extending substantially along the forward length thereof, and said upper edge of the main boom and said lower edge of the dipper boom extend substantially parallel, proximate one another.

9. The loader-excavator as defined in claim 1 in which the dipper boom ram is located inside the main boom and the dipper boom when both are in their retracted positions.

10. The loader-excavator as defined in claim 1 in which the main ram is connected to the frame rearward of said second pivot, and the dipper boom ram is connected to the rearward portion of the main boom for positioning of the dipper boom ram below the third pivot with the main boom and dipper boom in their retracted positions.

11. The loader-excavator as defined in claim 1 in which the main boom includes a first segment extending generally rearwardly from the first pivot to a first portion and a second segment extending generally upwardly from said rearward portion to an upper portion offset from the first segment when the main boom is in its retracted position, and in which the third pivot is located in the upper offset portion of the main boom.

12. The loader-excavator as defined in claim 1 in which the main boom and the dipper boom each have forward and rearward portions when in their retracted positions, and the dipper boom ram is connected between said rearward portion of the main boom and said forward portion of the dipper boom.

13. A loader-excavator configured for alternate use with a loader bucket and an excavator bucket, the loader-excavator comprising:

a) a mobile frame powered for forward and rearward movement;

b) a main boom connected to the frame at a first pivot for movement between a retracted position and an extended position, the main boom extending generally rearwardly from the first pivot;

c) first and second links connected together at a second pivot rearwardly of the first pivot and generally below the main boom when in its retracted position, the first and second links being further pivotally connected to the frame and the main boom respectively, the first and second links being pivotable from a first position with the main boom in its retracted position to a second position for movement of the main boom to its extended position;

d) a main ram connected between the second pivot and the frame rearwardly of the second pivot and at a height substantially below the main boom when in its retracted position, the main ram being operable to actuate said links between said first and second positions for movement of the main boom between its retracted and extended positions respectively;

e) a dipper boom connected to the main boom at a third pivot for movement between a retracted position and an extended position, the third pivot being located rearwardly of the first pivot with the main boom in its retracted position, the dipper boom extending generally forwardly from the third pivot and proximately over the main boom with the main boom and dipper boom in their retracted positions;

f) a dipper boom ram connected between the main boom and the dipper boom, the dipper boom ram being operable to pivot the dipper boom between its retracted and extended positions, the dipper boom ram crossing a line that extends through the first and third pivots when viewed orthogonal to the pivotal axes thereof;

g) a dipper boom extension connected to the dipper boom at a fourth pivot for movement between a retracted position and an extended position, the dipper boom extension extending generally downwardly from said fourth pivot to proximate said first pivot forwardly thereof with the main boom and dipper boom and dipper boom extension all in their retracted positions;

h) a dipper extension ram connected between the dipper boom and the dipper boom extension, the dipper extension ram being operable to pivot the dipper boom extension between its retracted and extended positions, and i) a lock mechanism for selectively coupling the loader bucket and the excavator bucket to the dipper boom extension.

14. The loader-excavator as defined in claim 13 in which the height of the fourth pivot is closer to the height of the first pivot than the height of the third pivot with the main boom and dipper boom and dipper boom extension all in their retracted positions, and in which the dipper boom extension is substantially shorter in length between said fourth pivot and said lock mechanism than the length of the dipper boom between said third and fourth pivots.

15. The loader-excavator as defined in claim 13 in which the dipper boom ram is connected between the rearward portion of the main boom and the forward portion of the dipper boom.

16. A loader-excavator configured for alternate use with a loader bucket and an excavator bucket, the loader-excavator comprising:

a) a mobile frame powered for forward and rearward movement;

b) a main boom connected to the frame at a first pivot for movement between a retracted position and an extended position, the main boom having a first segment extending generally rearwardly from the first pivot to a rearward portion and a second segment extending generally upwardly from said rearward portion to an upper portion offset from the first segment when the main boom is in its retracted position;

c) first and second links connected together at a second pivot rearwardly of the first pivot and generally below the main boom when in its retracted position, the first and second links being further pivotally connected to the frame and the main boom respectively, the first and second links being pivotable from a first position with the main boom in its retracted position to a second position for movement of the main boom to its extended position;

d) a main ram connected between the second pivot and the frame, the main ram being operable to actuate said links between said first and second positions for movement of the main boom between its retraced and extended positions respectively;

e) a dipper boom connected to the main boom at a third pivot for movement between a retracted position and an extended position, the third pivot being located in the upper offset portion of the main boom, the dipper boom extending generally forwardly from the third pivot and proximately over the main boom with the main boom and dipper boom in their retracted positions;

f) a dipper boom ram connected between the main boom proximate said rearward portion and the dipper boom forwardly of the third pivot, the dipper boom ram being operable to pivot the dipper boom between its retracted and extended positions;

g) a dipper boom extension connected to the dipper boom at a fourth pivot for movement between a retracted position and an extended position;

h) a dipper extension ram connected between the dipper boom and the dipper boom extension, the dipper extension ram being operable to pivot the dipper boom extension between its retracted and extended positions, and i) a lock mechanism for selectively coupling the loader bucket and the excavator bucket to the dipper boom extension.

17. The loader-excavator as defined in claim 16 in which the dipper boom ram is located inside the main boom and the dipper boom when both are in their retracted positions.

18. The loader-excavator as defined in claim 16 in which the height of the fourth pivot is closer to the height of the first pivot than the height of the third pivot with the main boom and dipper boom and dipper boom extension all in their retracted positions, and in which the dipper boom extension is substantially shorter in length between said fourth pivot and said lock mechanism than the length of the dipper boom between said third and fourth pivots.

19. The loader-excavator as defined in claim 16 in which, when the main boom and dipper boom are both in their retracted positions: the main boom includes an upper edge extending substantially along the forward length thereof, the dipper boom includes a lower edge extending substantially along the forward length thereof, and said upper edge of the main boom and said lower edge of the dipper boom extend substantially parallel, proximate one another.

* * * * *